US009257069B2

(12) United States Patent
Kaplan et al.

(10) Patent No.: US 9,257,069 B2
(45) Date of Patent: Feb. 9, 2016

(54) ORGANIC LIGHT EMITTING DIODE DISPLAY AND METHOD OF DRIVING THE SAME

(71) Applicant: SAMSUNG DISPLAY CO., LTD., Yongin, Gyeonggi-do (KR)

(72) Inventors: Leonid Kaplan, Yongin (KR); Heung-Yeol Na, Yongin (KR); Ho-Ryun Chung, Yongin (KR); Wang-Jo Lee, Yongin (KR); Jang-Doo Lee, Yongin (KR)

(73) Assignee: SAMSUNG DISPLAY CO., LTD., Yongin, Gyeonggi-Do (KR)

( * ) Notice: Subject to any disclaimer, the term of this patent is extended or adjusted under 35 U.S.C. 154(b) by 115 days.

(21) Appl. No.: 14/108,483

(22) Filed: Dec. 17, 2013

(65) Prior Publication Data

US 2014/0313242 A1 Oct. 23, 2014

(30) Foreign Application Priority Data

Apr. 17, 2013 (KR) ..... 10-2013-0042358

(51) Int. Cl.
*G09G 3/32* (2006.01)

(52) U.S. Cl.
CPC ..... *G09G 3/3208* (2013.01); *G09G 2330/028* (2013.01)

(58) Field of Classification Search
CPC ..... G09G 3/30; G09G 3/3208; G09G 3/3225; G09G 3/3233; G09G 3/3258; G09G 2330/028
See application file for complete search history.

(56) References Cited

U.S. PATENT DOCUMENTS

| | | | | |
|---|---|---|---|---|
| 6,809,482 | B2 | 10/2004 | Koyama | |
| 2005/0030268 | A1 * | 2/2005 | Zhang et al. | 345/83 |
| 2010/0277513 | A1 * | 11/2010 | Byun | 345/690 |

FOREIGN PATENT DOCUMENTS

| | | | |
|---|---|---|---|
| KR | 10-2005-0058473 | A | 6/2005 |
| KR | 10-2009-0011752 | A | 2/2009 |
| KR | 10-2010-0118773 | A | 11/2010 |

* cited by examiner

*Primary Examiner* — Regina Liang
(74) *Attorney, Agent, or Firm* — Lee & Morse, P.C.

(57) ABSTRACT

A controller for a display panel may include a first supply circuit to output first and second driving voltages to a sub-pixel of a first color; and a second supply circuit to output third and fourth driving voltages to a sub-pixel of a second color. The first driving voltage may be greater than the second driving voltage, and the third driving voltage may be greater than the fourth driving voltage. Also, at least three of the first, second, third, and fourth driving voltages may be different from one another.

19 Claims, 4 Drawing Sheets

ORGANIC LIGHT EMITTING DIODE DISPLAY AND METHOD OF DRIVING THE SAME

CROSS-REFERENCE TO RELATED APPLICATION

Korean Patent Application No. 10-2013-0042358, filed on Apr. 17, 2013, and entitled: "Organic Light Emitting Diode Display and Method of Driving the Same," is incorporated by reference herein in its entirety.

BACKGROUND

1. Field

Embodiments herein relate to an organic light emitting diode (OLED) display.

2. Description of the Related Art

OLED displays produce an image based on the recombination of electrons and holes in the active layer of a plurality of pixels. Each pixel may include a number of sub-pixels which emit, for example, red R, green G and blue B color light. While OLED displays have demonstrated superior performance over other types of displays, improvements are needed.

SUMMARY

Embodiments are directed to a control circuit for reducing power consumption and/or otherwise improving performance of a display panel.

In accordance with one embodiment, an organic light emitting diode (OLED) display includes a plurality of pixels, each including sub-pixels of different colors; a plurality of voltage supply lines to supply driving power source voltages to the sub-pixels; a signal controller to determine the driving power source voltages and to generate a voltage supply control signal including information indicative of the driving power source voltages; and a voltage supply unit to generate the driving power source voltages based on the voltage supply control signal and to transfer the driving power source voltages to the plurality of voltage supply lines, wherein the voltage supply unit generates different power source voltages for different ones of the sub-pixels. The sub-pixels emit light of different primary colors.

Also, the plurality of voltage supply lines may include a first voltage supply line to transfer a first driving voltage, a second voltage supply line to transfer a second driving voltage, a third voltage supply line to transfer a third driving voltage, and a fourth voltage supply line to transmit a fourth driving voltage, wherein the first and second driving voltages may be greater than the third and fourth driving voltages.

Also, the first driving voltage, the second driving voltage, the third driving voltage, and the fourth driving voltage may have different magnitudes.

Also, the first and second driving voltages may be different, and/or the third and forth driving voltages may be different. The third driving voltage or the fourth driving voltage may be substantially a ground voltage. The voltage supply unit may include a plurality of DC-DC converters to generate the driving power source voltages.

Also, each sub-pixel receives two driving power source voltages, and the power source voltages received by a first one of the sub-pixels of a first color are different from the power source voltages received by a second one of the sub-pixels of a second color.

Also, the at least three sub-pixels comprise a first sub-pixel, a second sub-pixel, and a third sub-pixel, the plurality of voltage supply lines comprise a first voltage supply line to transfer a first voltage, a second voltage supply line to transfer a second voltage, a third voltage supply line to transfer a third voltage, and a fourth voltage supply line to transfer a fourth voltage, the first sub-pixel and the second sub-pixel are connected to the first voltage supply line, the third sub-pixel is connected to the second voltage, the first sub-pixel is connected to the third voltage supply line, and the second sub-pixel and the third sub-pixel are connected to the fourth voltage supply line.

Also, one electrode of a driving transistor of the first sub-pixel and one electrode of a driving transistor of the second sub-pixel are connected to the first voltage supply line in common, and one electrode of a driving transistor of the third sub-pixel is connected to the second voltage supply line.

Also, one electrode of an organic light emitting diode (OLED) included in the first sub-pixel is connected to the third voltage supply line, and one electrode of an OLED included the second sub-pixel and one electrode of an OLED included in the third sub-pixel are connected to the fourth voltage supply line in common.

Also, the first voltage comprises a driving voltage of a color displayed by the second sub-pixel, the second voltage comprises a driving voltage of a color displayed by the third sub-pixel, the third voltage comprises a voltage obtained by subtracting a driving voltage of a color displayed by the first sub-pixel from the first voltage, and the fourth voltage comprises a ground voltage.

Also, the first voltage comprises a driving voltage of a color displayed by the first sub-pixel, the fourth voltage comprises a voltage obtained by subtracting a driving voltage of a color displayed by the second sub-pixel from the first voltage, the third voltage comprises a ground voltage, and the second voltage comprises a voltage obtained by adding the fourth voltage to a driving voltage of a color displayed by the third sub-pixel.

Also, the first voltage or the second voltage is determined as one of driving voltages for driving an organic light emitting element displaying a first color, a second color, and a third color.

In accordance with another embodiment, a method of driving an organic light emitting diode (OLED) display includes calculating driving power source voltages for different color sub-pixels; generating a control signal including information indicative of the calculated driving power source voltages; generating the driving power source voltages based on the voltage supply control signal; and supplying the generated driving power source voltages to voltage supply lines connected to the sub-pixels, wherein different power source voltages are supplied to the different color sub-pixels.

Also, the first and second driving power source voltages may be supplied to voltage supply lines connected to a sub-pixel of a first color, and third and fourth driving power source voltages may be supplied to voltage supply lines connected to a sub-pixel of a second color, wherein the first, second, third, and fourth driving power source voltages are different from one another. The third driving voltage or the fourth driving voltage may be substantially a ground voltage.

In accordance with another embodiment, a controller for a display panel includes a first supply circuit to output first and second driving voltages to a sub-pixel of a first color; and a second supply circuit to output third and fourth driving voltages to a sub-pixel of a second color, wherein the first driving voltage is greater than the second driving voltage and wherein the third driving voltage is greater than the fourth driving voltage, and wherein at least three of the first, second, third, and fourth driving voltages are different from one another. The first, second, third, and fourth driving voltages are different from one another.

BRIEF DESCRIPTION OF THE DRAWINGS

Features will become apparent to those of ordinary skill in the art by describing in detail exemplary embodiments with reference to the attached drawings in which.

DETAILED DESCRIPTION

Figure 1:
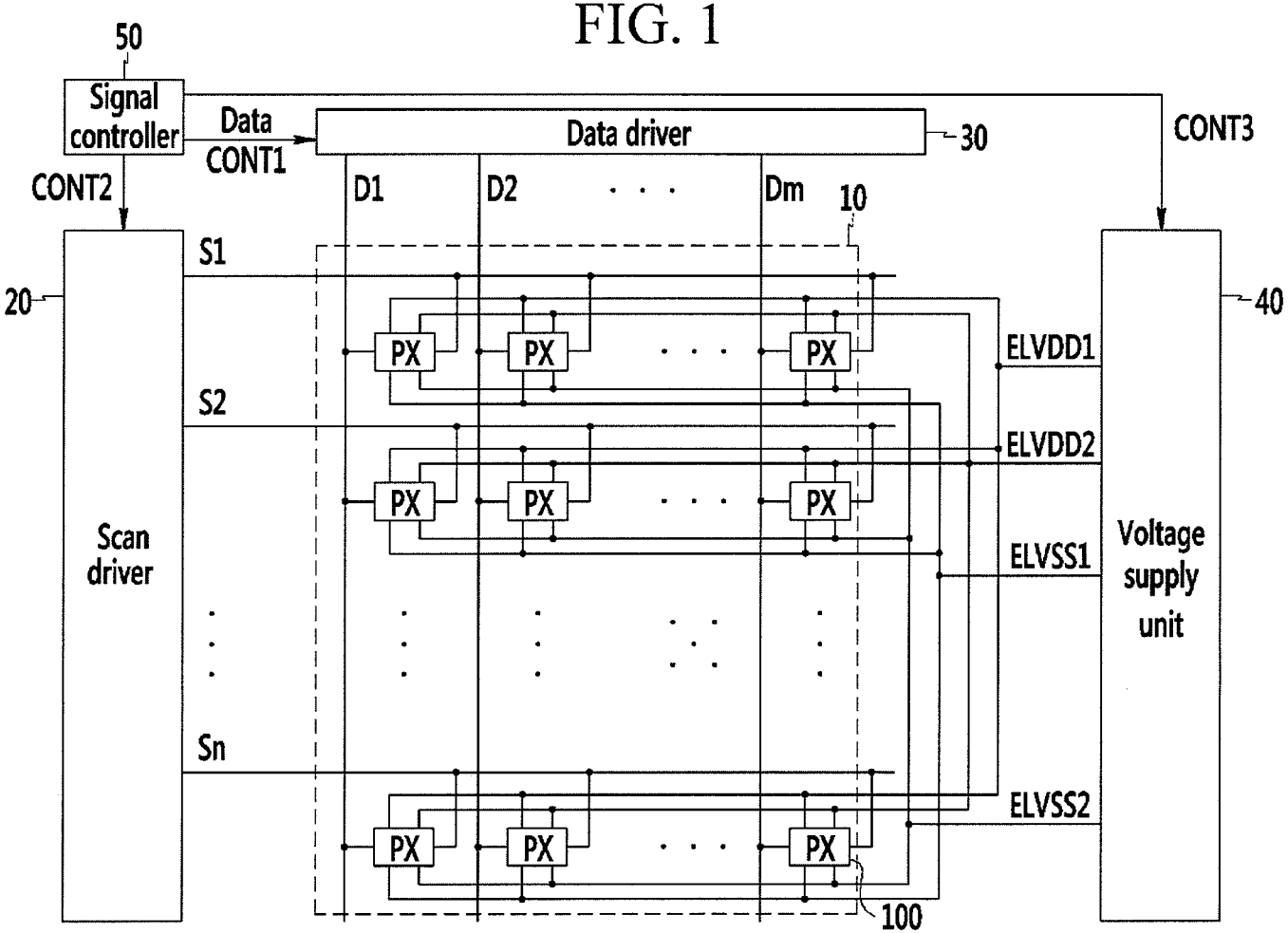
FIG. 1 illustrates an embodiment of an OLED display.

Example embodiments will now be described more fully hereinafter with reference to the accompanying drawings; however, they may be embodied in different forms and should not be construed as limited to the embodiments set forth herein. Rather, these embodiments are provided so that this disclosure will be thorough and complete, and will fully convey exemplary implementations to those skilled in the art.

In the drawing figures, the dimensions of layers and regions may be exaggerated for clarity of illustration. It will also be understood that when a layer or element is referred to as being "on" another layer or substrate, it can be directly on the other layer or substrate, or intervening layers may also be present. Further, it will be understood that when a layer is referred to as being "under" another layer, it can be directly under, and one or more intervening layers may also be present. In addition, it will also be understood that when a layer is referred to as being "between" two layers, it can be the only layer between the two layers, or one or more intervening layers may also be present. Like reference numerals refer to like elements throughout.

FIG. 1 illustrates an embodiment of an OLED display including a display unit 10, a scan driver 20, a data driver 30, a voltage supply unit 40, and a signal controller 50.

The display unit 10 includes a plurality of pixels which are connected to a plurality of scan lines S1 to Sn extending in a first direction (column direction), a plurality of data lines D1 to Dm extending in a second direction (row direction), and a plurality of voltage supply lines ELVDD1, ELVDD2, ELVSS1, and ELVSS2 extending in the first direction (column direction), respectively. A connection structure between the plurality of scan lines, the data lines, and voltage supply lines is not limited to an exemplary embodiment of FIG. 1.

Although not shown in FIG. 1, each of the plurality of pixels includes three sub-pixels which emit red, green, and blue lights, respectively. Each of the plurality of pixels is activated according to a scan signal received through a corresponding scan line among the plurality of scan lines, and each of the sub-pixels emits a corresponding color light according to a driving current that is based on a data signal received through a corresponding data line, among the plurality of data lines to display an image.

According to at least one embodiment, the sub-pixels of each pixel emit red, green, or blue light with preset voltages that are based on driving power source voltages. The driving power source voltages are transferred to plurality of voltage supply lines in order to reduce power consumption. That is, in order to display the colors, respective sub-pixels included in each pixel alternately display a primary color for each sub-pixel according to a supplied driving power source voltage, so that an image is implemented on the whole display unit on a space-sum or time-sum basis.

In displaying an image on a time-sum basis, respective sub-pixels of one pixel emit red R, green G, and blue B light in time according to a plurality of driving power source voltages supplied to the sub-pixels, so that one color is implemented per pixel.

In displaying an image on a space-sum basis, each pixel emits a color by combining three primary colors emitted by its three sub-pixels. The display unit of the whole display panel may then express an image of a corresponding frame through a space combination of a plurality of pixels arranged in a row direction or a column direction. In one embodiment, one frame may include at least one sub-frame, e.g., one frame may include three sub-frames corresponding to three sub-pixels displaying respective primary colors in one pixel.

The signal controller 50 may drive a plurality of sub-frames divided from one frame, and convert an external video signal so that an image may be displayed corresponding to each sub frame. A gray scale in each of the plurality of pixels is displayed by a combination of sub-frames of a sub-pixel emitting light according to an image data signal corresponding to a sub-frame.

The scan driver 20 sequentially generates and applies a scan signal to scan lines S1-Sn every sub-frame, respectively.

The data driver 30 generates and applies a data voltage according to a data signal Data converted from the signal controller 50 to data lines D1 to Dm every sub-frame. In this case, the data signal refers to data converted by the signal controller 50 according to a sub-frame, and a corresponding data signal is transmitted to the data line according to the sub-frame. Also, the data lines D1 to Dm may include three data lines connected to every sub-pixel of one pixel.

The voltage supply unit 40 applies a plurality of driving power source voltages for generating light emission in the organic light emitting elements that comprise each of the plurality of pixels. As shown in FIG. 1, the driving power source voltages are supplied along a plurality of voltage supply lines ELVDD1, ELVDD2, ELVSS1, and ELVSS2, respectively. These driving power source voltages may have different magnitudes and may correspond to predetermined voltages previously set by the signal controller 50. In one embodiment, the voltage supply lines ELVDD1, ELVDD2, ELVSS1, and ELVSS2 are connected in a different configuration to the three sub-pixels of each pixel, in a manner that will be described in greater detail below.

The first voltage supply line ELVDD1 and the second voltage supply line ELVDD2 may transmit driving power source voltages having predetermined different high potentials, and the third voltage supply line ELVSS1 and the fourth voltage supply line ELVSS2 may transmit driving power source voltages having predetermined different low potentials.

Accordingly, the first voltage supply line ELVDD1 or the second voltage supply line ELVDD2 is connected to a first electrode (e.g., anode) of an OLED in each sub-pixel, to apply a driving power source voltage having a predetermined high potential. The third voltage supply line ELVSS1 or the fourth voltage supply line ELVSS2 is connected to a second electrode (e.g., cathode) of an OLED in each sub-pixel, to apply a driving power source voltage having a predetermined low potential. The voltage supply lines connected to the anodes and cathodes of the three sub-pixels included in one pixel, therefore, may have different connection structures.

The signal controller 50 receives and converts an external video signal into an image data signal Data corresponding to a sub-frame, and transmits the converted image data signal Data to the data driver 30.

Further, the signal controller 50 generates a plurality of driving control signals for controlling driving operations of the scan driver 20, the data driver 30 and the voltage supply unit 40, and transmits the driving control signals to the scan driver 20, the data driver 30 and the voltage supply unit 40, respectively.

More specifically, as illustrated in FIG. 1, the plurality of driving control signals include a data driving control signal CONT1 for controlling an operation of the data driver 30, a scan driving control signal CONT2 for controlling an operation of the scan driver 20, and a power supply control signal CONT3 for setting a driving power source voltage generated and transmitted by the voltage supply unit 40 and for controlling a driving operation of the voltage supply unit 40.

The scan driver 20, the data driver 30, the voltage supply unit 40, and the signal controller 50 may be electrically connected to the display unit 10 and may be mounted, for example, on a flexible printed circuit (FPC) or film adhering to and electrically connected to the display unit 10 in the form of a chip. The scan driver 20, the data driver 30, the voltage supply unit 40, and the signal controller 50 may be directly mounted on a glass substrate of the display unit 10, and may be aligned on the same layer with the scan line, the data line, voltage supply, and a thin film transistor on the glass substrate.

Figure 2:
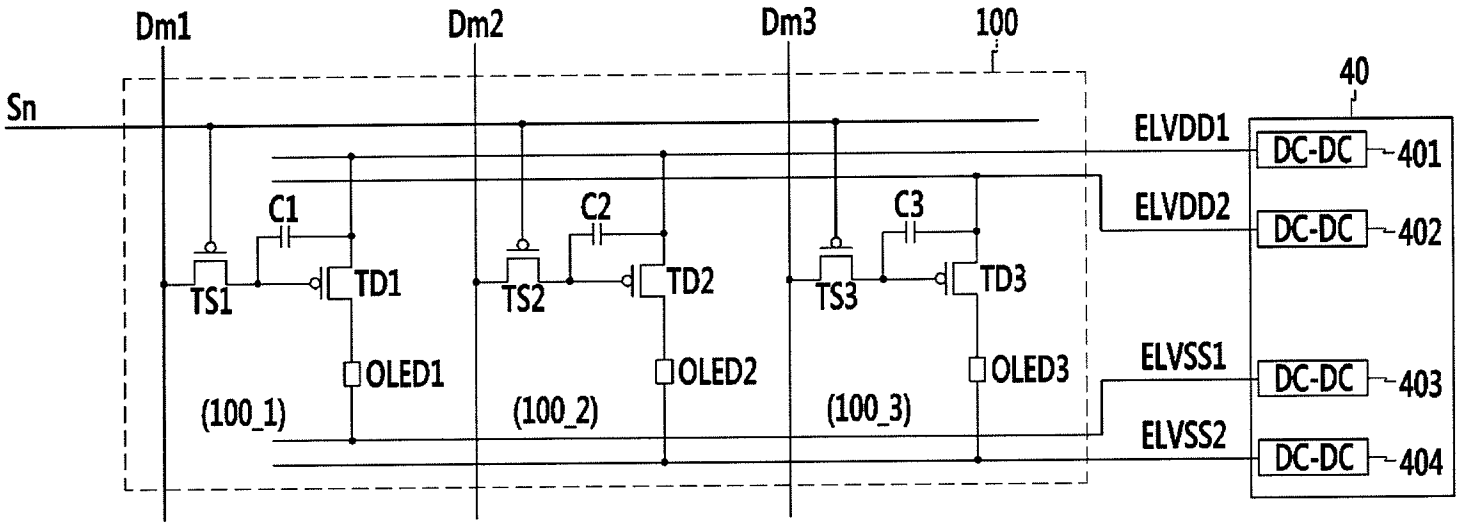
FIG. 2 illustrates a portion of the OLED display in FIG. 1.

FIG. 2 illustrates an embodiment of a connection structure between the voltage supply unit 40 and a pixel 100 of the OLED. In this embodiment, the pixel 100 is arranged at an m-th row of an n-th pixel line in the display unit 10 in FIG. 1. The same connection structure may obtain for remaining ones of the pixels.

As shown in FIG. 2, the pixel 100 includes a first sub-pixel 100_1, a second sub-pixel 100_2, and a third sub-pixel_3 emitting red, a green, and a blue light. The first to third sub-pixels are connected to an n-th scan line Sn and a corresponding plurality of m-th data lines labeled Dm1 to Dm3, respectively.

The voltage supply unit 40 includes a plurality of direct current (DC)-DC converters 401 to 404 generating driving power source voltages to be applied to corresponding voltage supply lines based on the power supply control signal CONT3. The power supply control signal CONT 3 may include information about a plurality of driving power source voltages set in a signal control line (not shown in FIG. 2).

More specifically, the first DC-DC converter 401 generates a first voltage as a driving power source voltage having a predetermined high potential to be applied to the first voltage supply line ELVDD1. The second DC-DC converter 402 generates a second voltage as a driving power source voltage having a predetermined high potential to be applied to the second voltage supply line ELVDD2. The third DC-DC converter 403 generates a third voltage as a driving power source voltage having a predetermined low potential to be applied to the third voltage supply line ELVSS1. The fourth DC-DC converter 404 generates a fourth voltage as a driving power source voltage to be applied to the fourth voltage supply line ELVSS2.

Accordingly, two of the three sub-pixels in each pixel are connected to the same driving power supply voltages, and the third sub-pixel in each pixel is connected to one or more different driving power supply voltages. The plurality of voltages ELVDD1, ELVDD2, ELVSS1, and ELVSS2, therefore, are connected to three sub-pixels included in one unit pixel have different connection structures.

In addition, the first voltage or the second voltage is applied to anodes of the organic light emitting elements in the sub-pixels, and the third voltage or the fourth voltage is applied to cathodes of the organic light emitting elements. Also, as shown in FIG. 2, the sub-pixels of each pixel 100 may have the same configuration, but at least one of the sub-pixels is connected to one or more different voltage supply lines compared to the other sub-pixels of the pixel.

In accordance with one embodiment, each sub-pixel of the unit pixel 100 includes two transistors, one capacitor, and on organic light emitting element (OLED). The transistor according to the exemplary embodiment of FIG. 2 is a PMOS transistor, but is not limited to the PMOS transistor.

The first sub-pixel 100_1 includes a switching transistor TS1 having a gate electrode connected to an n-th scan line Sn, a source electrode connected to a corresponding data line Dm1 among m-th data lines, and a drain electrode connected to a first node N1. Further, the first sub-pixel 100_1 includes a driving transistor TD1 having a gate electrode connected to the node N1, a source electrode connected to the first voltage supply line ELVDD1, and a drain electrode connected to an organic light emitting diode OLED1.

The capacitor C1 included in the first sub-pixel 100_1 includes two electrodes connected to the node N1 and the source electrode of the driving transistor TD1. In addition, the OLED1 of the first sub-pixel 100_1 includes an anode connected to the drain electrode of the driving transistor TD1 and a cathode connected to the third voltage supply line ELVSS1.

The second sub-pixel 100_2 includes a switching transistor TS2 having a gate electrode connected to the n-th scan line Sn, a source electrode connected to a corresponding data line Dm2 among the m-th data lines, and a drain electrode connected to a node N2. Further, the second sub-pixel 100_2 includes a driving transistor TD2 having a gate electrode connected to the node N2, a source electrode connected to the first voltage supply line ELVDD1, and a drain electrode connected to an organic light emitting diode OLED2.

The capacitor C2 included in the second sub-pixel 100_2 includes two electrodes connected to the node N2 and the source electrode of the driving transistor TD2, respectively. Moreover, OLED2 of the second sub-pixel 100_2 includes an anode connected to the drain electrode of the driving transistor TD2 and a cathode connected to the fourth voltage supply line ELVSS2.

The third sub-pixel 100_3 includes a switching transistor TS3 having a gate electrode connected to the n-th scan line Sn, a source electrode connected to a corresponding data line Dm3 among the m-th data lines, and a drain electrode connected to a node N3. The third sub-pixel 100_3 includes a driving transistor TD3 having a gate electrode connected to the node N3, a source electrode connected to the second voltage supply line ELVDD2, and a drain electrode connected to an organic light emitting diode (OLED) 303.

The capacitor C3 included in the third sub-pixel 100_2 includes two electrodes connected to the node N3 and the source electrode of the driving transistor TD3, respectively. In addition, the OLED 303 of the third sub-pixel 100_3 includes an anode connected to the drain electrode of the driving transistor TD3 and a cathode connected to the fourth voltage supply line ELVSS2.

According to the pixel structure of FIG. 2, if a scan signal of predetermined gate on voltage level is applied to the n-th scan line Sn every sub-frame of a corresponding frame, respective sub-pixels of the pixel 100 are activated. That is, a switching transistor of each sub-pixel is turned-on and receives an image data signal of a corresponding sub-frame through a predetermined m-th data line.

The capacitor of each sub-pixel stores and maintains a data voltage according to an image data signal of a corresponding sub-frame for predetermined time, and the driving transistor of each sub-pixel flows a driving current according to the data voltage to the OLED so that the OLED emits a corresponding color light.

In this case, the organic light emitting diode (OLED) of each sub-pixel emits one of red, green and blue lights corresponding to the difference between a driving power source voltage, having a predetermined high potential applied through the first voltage supply line ELVDD1 or the second voltage supply line ELVDD2 connected to an anode of the OLED, and a driving power source voltage having a predetermined low potential applied through the third voltage supply line ELVSS1 or the fourth voltage supply line ELVSS2 connected to a cathode of the OLED.

According to one related art display device, a same driving power source voltage having a constant value is applied to all pixels in the device. Because a required driving voltage may vary according to a color of light to be emitted, power is unnecessarily consumed by applying the same driving power source voltages to all pixels and sub-pixels irrespective of color.

More specifically, the power Ptft consumed in a unit pixel may be determined as the product of a driving voltage Vtft of a driving transistor and a driving current Ioled flowing from the driving transistor to the OLED (i.e., Ptft=Vtft×Ioled). When this is the case, the driving voltage Vtft of the driving transistor is affected by a voltage drop between an anode and a cathode of the OLED. As a result, the power consumption in the unit pixel is affected by a voltage drop between the two electrodes of the OLED.

One or more embodiments described herein may deliver improve power characteristics by providing different power supply voltages to sub-pixels of different colors. More specifically, realizing that a voltage drop value varies according to color (e.g., varies among primary colors of red, green, and blue) to be emitted by the OLEDs, one or more embodiments herein apply different driving power source voltages to different color sub-pixels of a unit pixel. As a result, different amounts of power can be consumed by the sub-pixels, which may lead to a reduction of unnecessary power consumption in the entire pixel.

Figure 3:
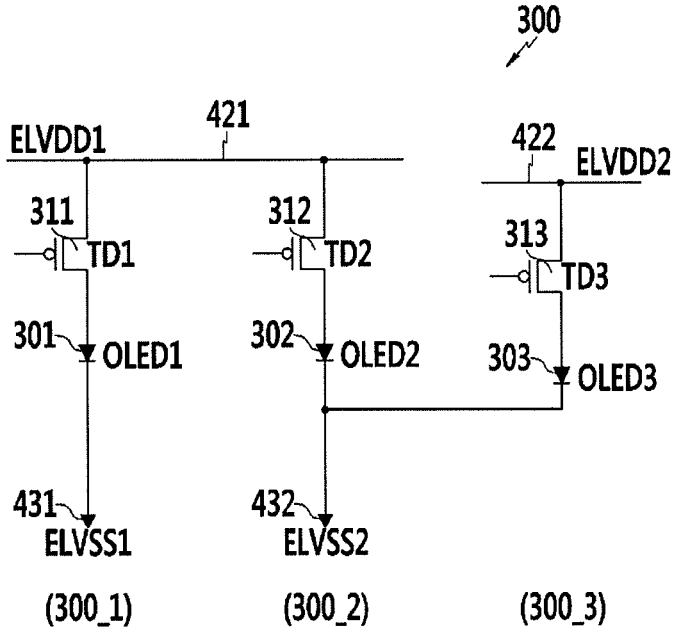
FIG. 3 illustrates an embodiment of a partial connection structure of a pixel and a voltage supply line of an OLED display.

FIG. 3 illustrates one embodiment of a connection structure of driving transistors and OLEDs of respective sub-pixels in a unit pixel to voltage supply lines. Each of sub-pixels 300_1, 300_2, and 300_3 included in the unit pixel 300 includes a driving transistor and an OLED, being an emissive device which receives a driving current from the driving transistor to emit the light. The three sub-pixels emit light with one primary color of a red, a green and a blue to express a gray scale with respect to one frame. In other embodiments, the sub-pixels may emit another combination of colors and/or more than three sub-pixels may be included per unit pixel. Examples of additional or different sub-pixels include ones emitting white light or yellow light.

Referring to FIG. 3, a first sub-pixel 300_1 among the three sub-pixels includes a first driving transistor 311 and a first OLED 301. A second sub-pixel 300_2 includes a second driving transistor 312 and a second OLED 302. Further, the third sub-pixel 300_3 includes a third driving transistor 313 and a third OLED 303.

Driving power source voltages for driving sub-pixels 300_1, 300_2, 300_3 in FIG. 3 are connected to two supply lines. That is, a first voltage supply line (ELVDD1) 421 and a second voltage supply line (ELVDD2) 422 supply high potential power source voltages. In FIG. 3, driving transistor 311 and 312 of the first sub-pixel 300_1 and the second sub-pixel 300_2 are connected to the first voltage supply line (ELVDD1) 421, and a driving transistor 313 of the third sub-pixel 300_3 is connected to the second voltage supply line (ELVDD2) 422.

A predetermined first power source voltage VELVDD1 generated from a DC-DC converter 401 of the voltage supply unit 40 is applied to source electrodes of driving transistors 311 and 312 of the first sub-pixel 300_1 and the second sub-pixel 300_2 through the first voltage supply line 421.

A predetermined second power source voltage VELVDD2 generated from the DC-DC converter 420 of the voltage supply unit 40 is applied to a source electrode of a driving transistor 313 of the third sub-pixel 300_3 through a second voltage supply line 422.

The first power source voltage VELVDD1 and the second power source voltage VELVDD2 are determined, for example, by the signal controller 50 and are generated from DC-DC converters 401 and 402 of the voltage supply unit 40. The DC-DC converters 401 and 402 receive information about corresponding driving power source voltages to be transferred to sub-pixels of each unit pixel of the display device through two voltage supply lines.

Drain electrodes of driving transistors 311, 312, and 313 of the first to third sub-pixels are connected to anodes of OLEDs, respectively.

Further, the cathode electrode of the first OLED 301 of the first sub-pixel is connected to the third voltage supply line (ELVSS1) 431, and a cathode electrode of the second OLED 302 of the second sub-pixel and a cathode electrode of the third OLED 303 of the third sub-pixel are connected to the fourth voltage supply line (ELVSS2) 432.

A predetermined third power source voltage VELVSS1 generated from the DC-DC converter 403 of the voltage supply unit 40 is applied to a cathode electrode of the first OLED 301 of the first sub-pixel 300_1 through a third voltage supply line 431.

A predetermined fourth power source voltage VELVSS2 generated from the DC-DC converter 404 of the voltage supply unit is applied to a cathode electrode of the second OLED 302 of the second sub-pixel 300_2 and a cathode electrode of the third OLED 303 of the third sub-pixel 300_3 through a fourth voltage supply line 432.

Figure 4:
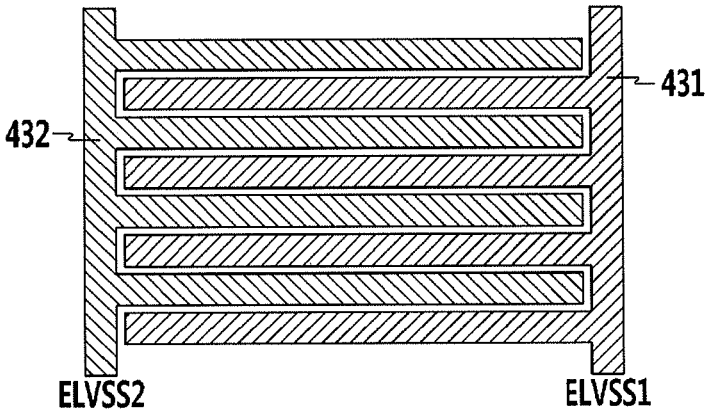
FIG. 4 illustrates an embodiment which includes an arrangement of the voltage supply line of the OLED display.

FIG. 4 illustrates an embodiment of an arrangement structure of a plurality of voltage supply lines of the OLED display shown in FIG. 3. As shown in FIG. 4, the third voltage supply line 431 is connected to the cathode electrode of OLED 301 and the fourth voltage supply line 432 is connected to cathode electrodes of OLEDs 302 and 303.

The third power source voltage VELVSS1 and the fourth power source voltage VELVSS2, applied through the third voltage supply line 431 and the fourth voltage supply line 432, are different from each other. The third and fourth power source voltages may be predetermined power source voltages having a low potential compared to the voltages coupled to the anode electrodes of the OLEDs. Further, one of the third power source voltage VELVSS1 and the fourth power source voltage VELVSS2 may be set as a ground voltage and the other may be another type of reference potential.

The arrangement structure of the third voltage supply line 431 and the fourth voltage supply line 432 may have a comb structure, in which the third voltage supply line 431 and the fourth voltage supply line 432 face each other over an entire region of a display panel. In this comb structure, the third and fourth voltage supply lines may not overlap each other. In other embodiments, the third and fourth voltage supply lines may be arranged according to a different structure, e.g., different from comb structure.

Further, in one embodiment, the arrangement structure of the first voltage supply line 421 and the second voltage supply line 422, connected to source electrodes of the first to third driving transistors 311, 312, and 313 of sub-pixels of the unit pixel, may be in a manner similar to that illustrated in FIG. 4.

Referring back to FIG. 3, the following is a description of a principle of reducing power consumption when respective color lights are implemented according to different power source voltages applied to sub-pixels 300_1, 300_2, and 300_3 of the unit pixel.

The first power source voltage VELVDD1, the second power source voltage VELVDD2, the third power source voltage VELVSS1, and the fourth power source voltage VELVSS2 are applied through respective voltage supply lines in FIG. 3 and may have different magnitudes as determined by the signal controller 50. Further, if information about different driving power source voltages is transmitted to the voltage supply unit 40 through the power supply control signal CONT3, different driving power source voltages are generated through a plurality of DC-DC converters.

In addition, the driving power source voltage is applied through a corresponding voltage supply line among the plurality of voltage supply lines connected to three sub-pixels of each of the plurality of pixels included in the display unit.

The sub-pixel may be selected so that a voltage drop due to driving transistors 311, 312, and 313 of respective sub-pixels is at a predetermined level. In one embodiment, the voltage drop may be equal to or almost zero at maximum luminance. This may be achieved by applying the first power source voltage VELVDD1, the second power source voltage VELVDD2, the third power source voltage VELVSS1, and the fourth power source voltage VELVSS2 having different magnitudes to three sub-pixels 300_1, 300_2, and 300_3 of the unit pixel through differently connected driving voltage supply lines as illustrated in FIG. 3.

In one implementation, the three sub-pixels 300_1, 300_2, and 300_3 included in each unit pixel may be selected so that a driving voltage VR applied to a red pixel, a driving voltage VG applied to a green pixel, a driving voltage VB applied to a blue pixel through supply of different driving power source voltages have magnitudes of VR>VG>VB.

Also, in one embodiment, the three sub-pixels may be provided so the first sub-pixel 300_1 is a blue sub-pixel, the second sub-pixel 300_2 a green sub-pixel, and the third sub-pixel 300_3 is a red sub-pixel. Given this arrangement, the first voltage supply line ELVDD1 is connected a blue first sub-pixel and a green second sub-pixel, and the second voltage supply line ELVDD2 is connected to a red third sub-pixel. Further, the third voltage supply line ELVSS1 is connected to the blue first sub-pixel, and the fourth voltage supply line ELVSS2 is connected to the green second sub-pixel and the red third sub-pixel.

Respective magnitudes of the first power source voltage VELVDD1, the second power source voltage VELVDD2, the third power source voltage VELVSS1, and the fourth power source voltage VELVSS2 determined and transmitted by the signal controller 50 are calculated based on Equation 1.

$$\begin{aligned} &\text{VELVDD1}=\text{VG} \\ &\text{VELVDD2}=\text{VR} \\ &\text{VELVSS1}=\text{VG}-\text{VB} \\ &\text{VELVSS2}=0 \end{aligned} \tag{1}$$

where VR represents a driving voltage for driving a red pixel, VG represents a driving voltage for driving a green pixel, VB represents a driving voltage for driving a blue pixel, and the VR, the VG, and the VB have magnitudes of VR>VG>VB.

Accordingly, different driving power source voltages may be applied to red, blue, and green sub-pixels using two high potential driving power source voltage supply lines and two low potential driving power source voltage supply lines, respectively.

According to Equation 1, different driving voltages, and specifically different power source voltages, for driving the first sub-pixel 300_1, the second sub-pixel 300_2, and the third sub-pixel 300_3 are VB, VG, and VR, respectively. Using different driving power source voltages for one or more color sub-pixels in each unit pixel may reduce power consumption in the display device. In other embodiments, different supply voltages may be provided to the sub-pixels of all the colors in a unit pixel.

The difference in the driving power source voltage of each sub-pixel may be understood to correspond to a difference in a power source voltage applied to the driving transistor and both terminals of the OLED which are coupled in series, which is a final driving voltage of the sub-pixel. Due to the difference in the driving power source voltage, a current path is formed from the driving transistor to the OLED so that light is emitted.

In order to drive light emission of each sub-pixel, a high potential power source voltage ELVDDx (the first power source voltage or the second power source voltage as previously described) applied to the source electrode of each driving transistor of the sub-pixel may correspond to at least a sum of: a voltage VTFTsat reduced due to a voltage drop with respect to a corresponding driving transistor greater than a low potential power source voltage ELVSSx (the third power source voltage or the fourth power source voltage in the present invention) applied to a cathode of each OLED, a voltage VOLEDx due to a voltage drop with respect to a corresponding OLED, amd ELVSSx (the third and fourth source voltages as previously described). That is, ELVDDx=VTFTsat+VOLEDx+ELVSSx.

Further, the three sub-pixels may be selected so the first sub-pixel 300_1 is a blue sub-pixel, the second sub-pixel 300_2 is a red sub-pixel, and the third sub-pixel 300_3 is a green sub-pixel. Accordingly, the first voltage supply line ELVDD1 is connected to a blue first sub-pixel and a blue second sub-pixel, and the second voltage supply line ELVDD2 is connected to a green third sub-pixel. Further, the third voltage supply line ELVSS1 is connected to the blue first sub-pixel, and the fourth voltage supply line ELVSS2 is connected to the red second sub-pixel and the green third sub-pixel.

In this case, respective magnitudes of the first power source voltage VELVDD1, the second power source voltage VELVDD2, the third power source voltage VELVSS1, and the fourth power source voltage VELVSS2 determined and transmitted by the signal controller 50 may be based on Equation 2:

$$\begin{aligned} &\text{VELVDD1}=\text{VR} \\ &\text{VELVDD2}=\text{VG} \\ &\text{VELVSS1}=\text{VR}-\text{VB} \\ &\text{VELVSS2}=0 \end{aligned} \tag{2}$$

According to Equation 2, driving voltages of driving the first sub-pixel 300_1, the second sub-pixel 300_2, and the third sub-pixel 300_3 correspond to VB, VG, and VR, respectively, so that suitable different driving power source voltages are supplied to respective sub-pixels implemented with a blue, a red, and a green. This may be performed because different color sub-pixels may require more or less driving power source voltage in order to emit light than other color sub-pixels.

As a result, a sub-pixel that requires relatively lower power source voltage than one or more other color sub-pixels to emit the same intensity of light may consume an unnecessary amount of power if supplied with the same power source voltages as those one or more other sub-pixels. In accordance with one or more embodiments, the power source voltage is selected to be different for at least one sub-pixel in each unit pixel, thereby reducing the likelihood of unnecessary power consumption.

Also, the three sub-pixels may be selected so the first sub-pixel 300_1 is a green sub-pixel, the second sub-pixel 300_2 is a red sub-pixel, and the third sub-pixel 300_3 is a blue sub-pixel.

Accordingly, the first voltage supply line ELVDD1 is connected to a green first sub-pixel and a red second sub-pixel, and the second voltage supply line ELVDD2 is connected to a blue third sub-pixel. Further, the third voltage supply line ELVSS1 is connected to the green first sub-pixel, and the fourth voltage supply line ELVSS2 is connected to the red second sub-pixel and the blue third sub-pixel.

In this case, respective magnitudes of the first power source voltage VELVDD1, the second power source voltage VELVDD2, the third power source voltage VELVSS1, and the fourth power source voltage VELVSS2 determined and transmitted by the signal controller 50 may be based on Equation 3:

$$\begin{aligned} &\text{VELVDD1}=\text{VR} \\ &\text{VELVDD2}=\text{VB} \\ &\text{VELVSS1}=\text{VR}-\text{VG} \\ &\text{VELVSS2}=0 \end{aligned} \tag{3}$$

According to Equation 3, driving voltages of driving the first sub-pixel 300_1, the second sub-pixel 300_2, and the third sub-pixel 300_3 corresponds to VB, VG, and VR, respectively, so that suitable driving power source voltages are differentially supplied to respective sub-pixels implemented with a blue, a red, and a green.

In the aforementioned embodiments, the fourth power source voltage VELVSS2 may always be set to a reference potentially, e.g., ground or 0 V. Further, the first power source voltage VELVDD1 may be determined as a driving voltage of a color expressed by the second sub-pixel 300_2 which is located at the center of the three sub-pixels. In this case, the second subpixel 300_2 is connected to another sub-pixel (first sub-pixel) and the first voltage supply line ELVDD1 in common, and is connected to another sub-pixel (third sub-pixel) and the fourth voltage supply line ELVSS2 in common.

The second power source voltage VELVDD2 may be a driving voltage of a color expressed by a sub-pixel (e.g., third sub-pixel) to which the second voltage supply line ELVDD2 is connected.

Further, the third power source voltage VELVSS1 may be a voltage obtained by subtracting a driving voltage of a color implemented by a sub-pixel (e.g., first sub-pixel) to which the third voltage supply line ELVSS1 is independently connected from the first power source voltage VELVDD1.

Meanwhile, in another embodiment, the three sub-pixels are selected so the first sub-pixel 300_1 is a red sub-pixel, the second sub-pixel 300_2 is a blue sub-pixel, and the third sub-pixel 300_3 is a green sub-pixel.

Accordingly, the first voltage supply line ELVDD1 is connected to a red first sub-pixel and a blue second sub-pixel, and the second voltage supply line ELVDD2 is connected to a green third sub-pixel. Further, the third voltage supply line ELVSS1 is connected to the red first sub-pixel, and the fourth voltage supply line ELVSS2 is connected to the blue second sub-pixel and the green third sub-pixel.

In this case, the signal controller 50 may calculate respective magnitudes of the first power source voltage VELVDD1, the second power source voltage VELVDD2, the third power source voltage VELVSS1, and the fourth power source voltage VELVSS2 to be transmitted to the voltage supply unit 40 based on Equation 4:

$$\begin{aligned} &\text{VELVDD1}=\text{VR} \\ &\text{VELVDD2}=\text{VG}+\text{VR}-\text{VB} \\ &\text{VELVSS1}=0 \\ &\text{VELVSS2}=\text{VR}-\text{VB} \end{aligned} \tag{4}$$

According to Equation 4, driving voltages of the first sub-pixel 300_1, the second sub-pixel 300_2, and the third sub-pixel 300_3 correspond to VB, VG, and VR, respectively, so that a driving voltage suitable for a color implemented by each sub-pixel is received to reduce power consumption.

Further, in another embodiment, the three sub-pixels are selected so the first sub-pixel 300_1 is a red sub-pixel, the second sub-pixel 300_2 is a green sub-pixel, and the third sub-pixel 300_3 is a blue sub-pixel.

Accordingly, the first voltage supply line ELVDD1 is connected to a red first sub-pixel and a green second sub-pixel, and the second voltage supply line ELVDD2 is connected to a blue third sub-pixel. Further, the third voltage supply line ELVSS1 is connected to the red first sub-pixel, and the fourth voltage supply line ELVSS2 is connected to the green second sub-pixel and the blue third sub-pixel.

In this case, the voltage supply unit 40 receives respective voltage information about the first power source voltage VELVDD1, the second power source voltage VELVDD2, the third power source voltage VELVSS1, and the fourth power source voltage VELVSS2 calculated based on Equation 5 from the signal controller 50 to differentially generate the power source voltage.

$$\begin{aligned} &\text{VELVDD1}=\text{VR} \\ &\text{VELVDD2}=\text{VB}+\text{VR}-\text{VG} \\ &\text{VELVSS1}=0 \\ &\text{VELVSS2}=\text{VR}-\text{VG} \end{aligned} \tag{5}$$

According to Equation 5, driving voltages of the first sub-pixel 300_1, the second sub-pixel 300_2, and the third sub-pixel 300_3 correspond to VR, VG, and VB so that driving voltages suitable for colors implemented by respective sub-pixels may be received.

Further, according to another embodiment, the three sub-pixels may be selected so the first sub-pixel 300_1 is a green sub-pixel, the second sub-pixel 300_2 is a blue sub-pixel, and the third sub-pixel 300_3 is a red sub-pixel.

Accordingly, the first voltage supply line ELVDD1 is connected to a green first sub-pixel and a blue second sub-pixel, and the second voltage supply line ELVDD2 is connected to a red third sub-pixel. Further, the third voltage supply line ELVSS1 is connected to the green first sub-pixel, and the fourth voltage supply line ELVSS2 is connected to the blue second sub-pixel and the red third sub-pixel.

In this case, the signal controller 50 may calculate information about the first power source voltage VELVDD1, the second power source voltage VELVDD2, the third power source voltage VELVSS1, and the fourth power source voltage VELVSS2 based on Equation 6 and may transmit the respectively calculated voltage information thereof to the signal controller 50.

$$VELVDD1=VG$$

$$VELVDD2=VR+VG-VB$$

$$VELVSS1=0$$

$$VELVSS2=VG-VB \quad (6)$$

According to Equation 6, driving voltages of the first sub-pixel 300_1, the second sub-pixel 300_2, and the third sub-pixel 300_3 correspond to VR, VG, and VB so that driving voltages suitable for red, green, and blue colors implemented by respective sub-pixels may be received.

In the aforementioned embodiments, the third power source voltage VELVSS1 may always be set to a predetermined reference potential, e.g., ground or 0 V.

Further, the first power source voltage VELVDD1 may be determined as a driving voltage of a color expressed by a sub-pixel (e.g., first sub-pixel) connected to the third voltage supply line ELVSS1 between two sub-pixels connected to the first voltage supply line ELVDD1 in common.

Further, the fourth power source voltage VELVSS2 among the plurality of driving power source voltages may be determined as a voltage obtained by subtracting a driving voltage of a color implemented by the second sub-pixel 300_2 from the first power source voltage VELVDD1. In this case, the second sub-pixel 300_2 and another sub-pixel (e.g., first sub-pixel) are connected to the first voltage supply line ELVDD1 in common, and the second sub-pixel 300_2 and another sub-pixel (e.g., third sub-pixel) are connected to the fourth voltage supply line ELVSS2 in common.

In addition, the second power source voltage VELVDD2 may be determined as a voltage obtained by adding the fourth power source voltage VELVSS2 to a driving voltage of a color expressed by a sub-pixel (e.g., third sub-pixel) independently connected to the second voltage supply line ELVDD2.

Accordingly, in accordance with one or more embodiments, the signal controller 50 may calculate a voltage using an arithmetic expression for determining four different driving power source voltages corresponding to the arrangement of sub-pixels by colors included in the plurality of pixels of the display unit and a connection structure of a voltage supply line transmitting the driving power source voltage. Further, the signal controller 50 may transmit the four different driving power source voltages to the voltage supply unit 40 through the voltage supply control signal so that each DC-DC converter included in the voltage supply unit 40 may generate a corresponding power source voltage.

Because the foregoing embodiments are provided as examples, the arithmetic expression determining a driving power source voltage by the signal controller 50 may vary according to the arrangement of sub-pixels and the connection structure of the voltage supply line transmitting the driving power source voltage.

By way of summation and review, different color sub-pixels in a display panel may require more or less driving power source voltage in order to emit light than other color sub-pixels. As a result, a sub-pixel that requires relatively lower power source voltage than one or more other color sub-pixels to emit the same intensity of light may consume an unnecessary amount of power if supplied with the same power source voltages as those one or more other sub-pixels. In accordance with one or more embodiments, the power source voltage is set to be different for at least one sub-pixel in each unit pixel, thereby reducing the likelihood of unnecessary power consumption. Moreover, the different power source voltages may be provided to the sub-pixels independently from one another. Also, in some embodiments, all three color sub-pixels may receive different diving power source voltages.

Example embodiments have been disclosed herein, and although specific terms are employed, they are used and are to be interpreted in a generic and descriptive sense only and not for purpose of limitation. In some instances, as would be apparent to one of ordinary skill in the art as of the filing of the present application, features, characteristics, and/or elements described in connection with a particular embodiment may be used singly or in combination with features, characteristics, and/or elements described in connection with other embodiments unless otherwise specifically indicated. Accordingly, it will be understood by those of skill in the art that various changes in form and details may be made without departing from the spirit and scope of the present invention as set forth in the following claims.

What is claimed is:

1. An organic light emitting diode (OLED) display, comprising:

a plurality of pixels, each including sub-pixels of different colors;

a plurality of voltage supply lines to supply driving power source voltages to the sub-pixels;

a signal controller to determine the driving power source voltages and to generate a voltage supply control signal including information indicative of the driving power source voltages; and a voltage supply to generate the driving power source voltages based on the voltage supply control signal and to transfer the driving power source voltages to the plurality of voltage supply lines, wherein the voltage supply is to generate different driving power source voltages for different ones of the sub-pixels, wherein anodes of OLEDs in at least two of the sub-pixels are to receive different ones of the driving power source voltages and cathodes of the OLEDs in at least two of the sub-pixels are to receive different ones of the driving power source voltages.

2. The display as claimed in claim 1, wherein the sub-pixels emit light of different primary colors.

3. The display as claimed in claim 1, wherein the plurality of voltage supply lines include:

a first voltage supply line to transfer a first driving power source voltage, a second voltage supply line to transfer a second driving power source voltage, a third voltage supply line to transfer a third driving power source voltage, and a fourth voltage supply line to transmit a fourth driving power source voltage, wherein the first and second power source driving voltages are greater than the third and fourth driving voltages.

4. The display as claimed in claim 3, wherein the first driving power source voltage, the second driving power source voltage, the third driving power source voltage, and the fourth driving power source voltage have different magnitudes.

5. The display as claimed in claim 3, wherein the first and second driving power source voltages are different.

6. The display as claimed in claim 3, wherein the third and fourth driving power source voltages are different.

7. The display as claimed in claim 3, wherein the third driving power source voltage or the fourth driving voltage is substantially a ground voltage.

8. The display as claimed in claim 1, wherein the voltage supply comprises a plurality of DC-DC converters to generate the driving power source voltages.

9. The display as claimed in claim 1, wherein:

each sub-pixel receives two driving power source voltages, and the driving power source voltages received by a first one of the sub-pixels of a first color are different from the driving power source voltages received by a second one of the sub-pixels of a second color.

10. The display as claimed in claim 1, wherein:

the at least three sub-pixels include a first sub-pixel, a second sub-pixel, and a third sub-pixel, the plurality of voltage supply lines include a first voltage supply line to transfer a first driving power source voltage, a second voltage supply line to transfer a second driving power source voltage, a third voltage supply line to transfer a third driving power source voltage, and a fourth voltage supply line to transfer a fourth driving power source voltage, the first sub-pixel and the second sub-pixel are connected to the first voltage supply line, the third sub-pixel is connected to the second voltage supply line, the first sub-pixel is connected to the third voltage supply line, and the second sub-pixel and the third sub-pixel are connected to the fourth voltage supply line.

11. The display as claimed in claim 10, wherein:

one electrode of a driving transistor of the first sub-pixel and one electrode of a driving transistor of the second sub-pixel are connected to the first voltage supply line in common, and one electrode of a driving transistor of the third sub-pixel is connected to the second voltage supply line.

12. The OLED display as claimed in claim 10, wherein:

one electrode of an organic light emitting diode (OLED) included in the first sub-pixel is connected to the third voltage supply line, and one electrode of an OLED included the second sub-pixel and one electrode of an OLED included in the third sub-pixel are connected to the fourth voltage supply line in common.

13. The display as claimed in claim 10, wherein:

the first driving power source voltage includes a driving voltage of a color displayed by the second sub-pixel, the second driving power source voltage includes a driving voltage of a color displayed by the third sub-pixel, the third driving power source voltage includes a voltage obtained by subtracting a driving voltage of a color displayed by the first sub-pixel from the first voltage, and the fourth driving power source voltage includes a ground voltage.

14. The display as claimed in claim 10, wherein:

the first driving power source voltage includes a driving voltage of a color displayed by the first sub-pixel, the fourth driving power source voltage includes a voltage obtained by subtracting a driving voltage of a color displayed by the second sub-pixel from the first voltage, the third driving power source voltage includes a ground voltage, and the second driving power source voltage includes a voltage obtained by adding the fourth voltage to a driving voltage of a color displayed by the third sub-pixel.

15. The display as claimed in claim 10, wherein the first driving power source voltage or the second driving power source voltage is determined as one of driving voltages for driving an organic light emitting element displaying a first color, a second color, and a third color.

16. A method of driving an organic light emitting diode (OLED) display, the method comprising:

calculating driving power source voltages for different color sub-pixels;

generating a control signal including information indicative of the calculated driving power source voltages;

generating the driving power source voltages based on the voltage supply control signal; and supplying the generated driving power source voltages to voltage supply lines connected to the sub-pixels, wherein different power source voltages are supplied to the different color sub-pixels, different ones of the driving power source voltages to be supplied to anodes of OLEDs in at least two of the sub-pixels and different ones of the driving power source voltages to be supplied to cathodes of the OLEDs in at least two of the sub-pixels.

17. The method as claimed in claim 16, wherein:

first and second driving power source voltages are supplied to voltage supply lines connected to a sub-pixel of a first color, and third and fourth driving power source voltages are supplied to voltage supply lines connected to a sub-pixel of a second color, wherein the first, second, third, and fourth driving power source voltages are different from one another.

18. The method as claimed in claim 17, wherein the third driving power source voltage or the fourth driving power source voltage is substantially a ground voltage.

19. A voltage supply for a display panel, the voltage supply comprising:

a first supply circuit to output first and second driving voltages to a sub-pixel of a first color, the first driving voltage to be output to a first electrode of a light emitter of the sub-pixel of the first color and the second driving voltage to be output to a second electrode of the light emitter of the sub-pixel of the first color; and a second supply circuit to output third and fourth driving voltages to a sub-pixel of a second color, the third driving voltage to be output to a first electrode of a light emitter of the sub-pixel of the second color and the fourth driving voltage to be output to a second electrode of the light emitter of the sub-pixel of the second color; wherein the first driving voltage is greater than the second driving voltage and wherein the third driving voltage is greater than the fourth driving voltage, and wherein the first, second, third, and fourth driving voltages are different from one another.

* * * * *